US005513850A

United States Patent [19]

Vancura

[11] Patent Number: 5,513,850

[45] Date of Patent: May 7, 1996

[54] CASINO DICE GAME METHOD OF PLAY

[76] Inventor: Olaf Vancura, 11 Linden Pl., Somerville, Mass. 02143

[21] Appl. No.: 405,154

[22] Filed: Mar. 16, 1995

[51] Int. Cl.[6] ..... A63F 3/00

[52] U.S. Cl. ..... 273/274

[58] Field of Search ..... 273/274, 146, 273/309

[56] References Cited

U.S. PATENT DOCUMENTS

| | | | |
|---|---|---|---|
| 4,129,304 | 12/1978 | Mager | 273/243 |
| 4,247,114 | 1/1981 | Carroll | 273/274 |
| 4,711,453 | 12/1987 | Saint Ive | 273/268 |
| 4,746,126 | 5/1988 | Angileri | 273/249 |
| 5,133,559 | 7/1992 | Page | 273/274 |
| 5,265,881 | 11/1993 | Doherty | 273/274 |
| 5,308,081 | 5/1994 | Bartle | 273/274 |
| 5,350,175 | 9/1994 | DiLullo et al. | 273/146 |

OTHER PUBLICATIONS

Scarne, John, "Scarne's New Complete Guide to Gambling," 1974 Fireside; pp. 259–341, 505–513 (259–307).

*Primary Examiner*—Benjamin H. Layno

[57] ABSTRACT

The invention comprises an independent event game that is easy-to-play and utilizes conventional six-sided dice. The game employs a method of developing a player's hand and a dealer's hand, each of which may have a value between 1 and 6 inclusive, or a wildcard value. After all rolling is completed, a comparison of player and dealer hand values determines the outcome of the main wagers. Several optional side bets including a jackpot bet are also available and may be wagered upon at various times throughout the game. The game is played on a playing surface with delineated areas for tracking the development of the game and for making wagers. Because both player and dealer see their hands evolve, culminating in a comparison of their values, the gaming method generates considerable excitement and interest.

22 Claims, 3 Drawing Sheets

8
12
16
14
18
Six Shootin' Showdown
Player's
Corral
Dealer's
Stable
Throws 1 2 3 4 5 or more Throws
2 Throws => Pays 3 to 2
4 Throws => Pays 4 to 1
3 Throws => Pays 2 to 1
5 or more Throws => Pays 4 to 1
No Claim Next Throw (Bar Doubles) 1 to 1
Pays 5 to 1
Player's Claim
Claim Next Throw 1 to 1
Tie 5 to 1
Double Six Shooter with $1 Bet Pays $600
Tie 5 to 1
WIN DEALER WIN
SHOWDOWN PLAYER SHOWDOWN
10
10
20
22
10
26
30
28
10
24
20
36
38
40
34
32
T
PC
DC
P P P
P P P
D D D
D D D

Figure 2:

Score Probabilities.

| | Hand Embodiment: | | | | |
|---|---|---|---|---|---|
| Final Outcome: | A: | B: | C: | D: | E: |
| Six Shooter | 720 / 46656 | 720 / 46656 | 3 / 63 | 30 / 1224 | 720 / 46656 |
| Claim of 1 | 4606 / 46656 | 11006 / 46656 | 10 / 63 | 199 / 1224 | 7656 / 46656 |
| Claim of 2 | 5706 / 46656 | 9546 / 46656 | 10 / 63 | 199 / 1224 | 7656 / 46656 |
| Claim of 3 | 6896 / 46656 | 8176 / 46656 | 10 / 63 | 199 / 1224 | 7656 / 46656 |
| Claim of 4 | 8176 / 46656 | 6896 / 46656 | 10 / 63 | 199 / 1224 | 7656 / 46656 |
| Claim of 5 | 9546 / 46656 | 5706 / 46656 | 10 / 63 | 199 / 1224 | 7656 / 46656 |
| Claim of 6 | 11006 / 46656 | 4606 / 46656 | 10 / 63 | 199 / 1224 | 7656 / 46656 |

Figure 3:

Theoretical House Expectation.

| Bet: | Advantage: |
|---|---|
| Player Showdown | + 2.20% |
| Dealer Win | + 3.16% |
| Tie | + 6.16% |
| Jackpot | +12.73% |
| Player's Claim | + 4.76% |
| 2 Throws | + 7.41% |
| 3 Throws | +15.12% |
| 4 Throws | +17.12% |
| 5 or more Throws | + 9.52% |
| Claim Next Throw | +11.11% |
| No Claim Next Throw | + 5.56% |

CASINO DICE GAME METHOD OF PLAY

FIELD OF THE INVENTION

This invention relates to betting games suitable for casino play.

BACKGROUND OF THE INVENTION

Casino games generally fall into two classes. The first class includes those games in which individual hands comprise dependent events. Blackjack, baccarat, Acey-Deucey, and any other card game with no shuffle in between hands are examples of dependent event games. The second class includes those games in which individual hands comprise independent events. This includes craps, roulette, and all other games in which every new game is, in principle, totally unrelated to past and future games. From the casino point of view, with all else being equal, independent event games are preferable because there is no mathematical way for a customer to develop a system to beat the game.

All casino games by their nature must have a positive expectation for the house. In addition, casino games should be easy to understand, easy to deal, and fun to play. These are attributes found in all table games. The most popular table game, blackjack, has an additional very important virtue, namely that players play against the dealer. The player and dealer each have unique cards associated with their respective hands and the hands are played separately. Players can see the development of each hand before a final comparison (unless the player busts) to determine the winner. Thus there is a spirit of competition between the player and the house.

In a game comprised of independent events in which player and dealer have separate hands, a break in symmetry must occur in order to assure the house advantage in the long run. In principle, this can be created in two ways: there can be an asymmetry in the way the dealer's and player's hands are constructed, so that the dealer's hand is preferentially stronger; or there can be a symmetry in hand construction but an asymmetry in payoffs so as to prefer the dealer, e.g. by inclusion of "bar" hands or a "dealer wins ties" stipulation in the determination of the payoffs.

Another desirable trait is to have the players interact in the game by physically taking part. The tactile sensation of holding a set of cards or rolling a pair of dice should not be underestimated in accounting for the popularity of games like craps and blackjack. Too, by touching the gaming apparatus, many players subscribe to the popular notion that their destiny can be somehow controlled. A drawback of American-style baccarat and roulette is that the player never touches the apparatus of the game.

Yet another desirable feature is to have a jackpot side bet. This jackpot bet is a popular feature of the Caribbean Stud card game, and jackpot side bets have appeared recently in variations of craps, roulette, and blackjack as well. Because some players are wary of their own chances, knowing "the odds are stacked for the dealer", a jackpot bet utilizing not only the player's hand but also the dealer's hand is especially alluring. Only the "Top of the Deck" blackjack side bet presently offers a jackpot reward if both player and dealer achieve a special hand. A drawback is that the Top of the Deck bet is only offered the first game after a shuffle and is thus unavailable most of the time.

All presently dealt casino dice games lack either the player vs. dealer motif, player involvement, or hand development. In particular, craps, 4-5-6, Pyramid dice, and Survival dice (DiLullo & Jorasch, U.S. Pat. No. 5,350,175) all have rules wherein a player tries to achieve a certain roll or sequence of rolls in order to win the game. There is no dealer hand, per se, and the only dealer interaction is as banker and administrator to the game. Another proposed game, Casino Merry Go Round (Page, U.S. Pat. No. 5,133,559), incorporates arbitrary "hands" for the dealer and player, but in fact the "hands" are established in one roll, so no development takes place. Furthermore, the non-standard dice are never touched by any player, so betting aside, there is no player interaction.

There is therefore a need for an independent event game that is exciting, easy-to-play, utilizes standard apparatus, and pits the players against the house via the means of distinct player's hands and dealer's hands, which the players and dealers themselves produce and can see develop. Ideally, such a game includes a jackpot side bet that is available every game and is dependent on both the player's and dealer's hand.

BRIEF SUMMARY OF THE INVENTION

The present invention is a method for playing a betting game that employs conventional six-sided dice or their video or mechanical equivalent. The game is played on a playing surface with delineated areas for tracking the development of the game and for making wagers with money, gaming chips, credits, or their video or mechanical equivalent, on whether player or dealer will win. The game employs a method of developing a player's hand and a dealer's hand, and comparing their respective values to determine the outcome of the main wagers.

In general, a player's score and dealer's score can each be established via one of five hand embodiments, with payoffs modified to account for the needed house advantage. Three of the hand embodiments use a series of one- or two-dice rolls and result in score distributions where each of the values 1 through 6 is symmetrical and equally likely to occur, with a chance of obtaining a wildcard score, called a "Six Shooter". Two hand embodiments use a total of 6 rolled dice and result in score distributions that are skewed toward either high or low values, also with a chance of obtaining a Six Shooter.

A preferred method of play is comprised of a designated dealer using a roll of four dice and a roll of two dice to establish a dealer score which is skewed toward high values. A designated "shooter", representing all players, uses a series of two dice rolls to establish a symmetrical player score. After both player and dealer score are established, the main wagers are resolved.

In a preferred embodiment, players are also allowed to place wagers on a jackpot side bet at the beginning of play, and other optional side bets throughout the course of play. Each side wager has its own rewards and rules for wagering and resolution. In particular, a jackpot side bet is offered with a very large payout for a "Double Six Shooter", whereby both player and dealer roll Six Shooters.

BRIEF DESCRIPTION OF THE DRAWINGS

The accompanying drawings illustrate the invention. In such drawings:

FIG. 2 is a table showing the theoretical distribution of scores for each embodiment of establishing the scores;

FIG. 3 is a table showing the theoretical house advantage for the preferred rewards in the preferred embodiment of the invention.

DETAILED DESCRIPTION OF THE PREFERRED EMBODIMENTS

Figure 1:
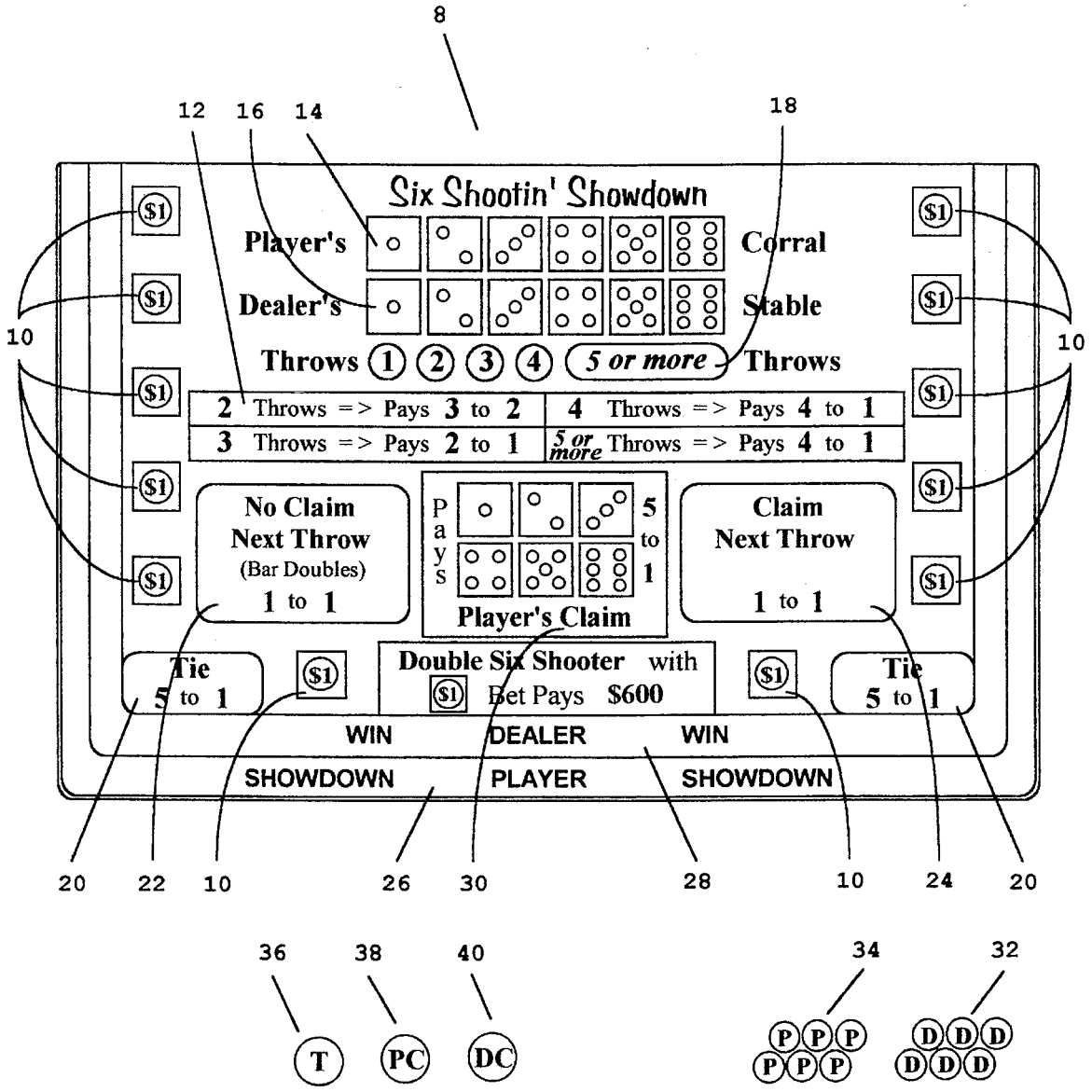
FIG. 1 is a top view illustration of a preferred layout for the preferred embodiment of the invention.

FIG. 1 shows a playing surface 8 for a betting game that employs conventional six-sided dice or their video or mechanical equivalent. A designated dealer or dealers, representing the casino, brokers the game and rolls to represent the house. A designated player, called a "Shooter", rolls to represent the players. In the preferred embodiment, the Shooter rolls red dice, while the designated dealer rolls brown dice.

A "Player's Corral" area 14 and a "Dealer's Stable" area 16 are each depicted with images of die faces indicating the numbers 1 through 6. In conjunction with a "Throws" area 18, these are the regions in which the progress of the game is recorded. In addition, several betting areas are indicated on the layout. These betting areas include a "Player Showdown" betting zone 26, a "Dealer Win" betting zone 28, two "Tie" betting zones 20, a "Throws" betting zone 12, a "Player's claim" betting zone 30, a "claim Next Throw" betting zone 24, a "No claim Next Throw" betting zone 22, and a plurality of "Jackpot" betting zones 10, said Jackpot zones being represented by individual betting squares placed on the layout. Payoffs are set for winning each type of bet.

Before play begins, players, by placing bets of money, gaming chips, credits, or their video or mechanical equivalent in the appropriate areas, :may wager on the main Player Showdown, Dealer Win, and Tie wagers or the Jackpot, Throws, or Player's claim side bets. The Player's claim side bet is made on the die in the Player's claim area 30 corresponding to the anticipated value.

Though the dealer will altogether roll six dice, the dealer initially begins by simultaneously rolling four dice whose values are measured by the number of dots appearing on the uppermost surface. For each of the four said rolled values, a D button 22 is placed on the corresponding number in the Dealer's Stable area 16. After the dealer initially rolls and before the Shooter begins rolling, players may continue to make wagers on the Throws 12 or Player's claim 30 side bets.

It is then the Shooter's turn. The player begins and continues to roll a pair of dice until a player's score is established subject to the following provisions. After each roll a counter button 36 is moved to the appropriate number of rolls on the Throws area 18. The Player's Corral area 14 of the layout starts off empty. During the player's rolling while the Player's Corral is still empty, players may make wagers on the Player's claim 30 side bets. If the player at any time rolls two different numbers neither of which appears in the Player's Corral 14, then these numbers are placed in the Player's Corral via the means of a dealer putting a P button 34 on each of the two corresponding numbers in the Player's Corral 14 area. If the player rolls doubles or two different numbers each of which already have buttons in the Player's Corral 14 area, there are no changes to the Player's Corral. The player's turn ends when the player rolls two different numbers such that one and only one of the rolled numbers matches an existing number in the Player's Corral, said matching number becoming a "Player's claim", said Player's claim becoming established at this point with the dealer placing an enlarged Player's claim button 38 on the appropriate die face of the Player's Corral area 14. If the player fills the Players Corral by rolling each of the numbers 1 through 6 before establishing a Player's claim, this is designated a "Player Six Shooter", (not a Player's claim) and the dealer leaves P buttons 34 on all six numbers in the Player's Corral area 14.

Once at least two numbers have been placed in the Player's Corral 14, players may make one-roll wagers on the No claim Next Throw 22 and claim Next Throw 24 side bets at any time while the shooter is rolling. No claim Next Throw and claim next Throw bets are always resolved on the next throw of the dice. In making the No claim Next Throw bet, a player is wagering that the shooter will not make a Player's claim on the very next throw of the dice. A Player Six Shooter does not count as a Player's claim. If the Player's claim is not established on the next throw of the dice, the payoff is 1 to 1, unless it is by reason of doubles being thrown, in which case the bet is a push. The house's theoretical expectation for the No claim Next Throw side bet is +5.56%. In making a claim Next Throw side bet, a player is wagering that the shooter will establish a Player's claim on the very next throw of the dice. A Player Six Shooter does not count as a Player's claim. Winning bets are paid 1 to 1. The house's theoretical expectation for the claim Next Throw side bet is +11.1%.

After the shooter has finished rolling and either established a Player's claim or a Player Six Shooter, all Throws side bets and Player's claim side bets are resolved. In making the Throws side bet, a player is wagering on the total number of throws the player will make. In the preferred embodiment, all throws count, including doubles and those which don't change the contents of the Player's Corral. All bets are resolved at the end of the player's hand. Winning hands are paid as follows: 2 Throws, 3 to 2; 3 Throws, 2 to 1; 4 Throws, 4 to 1; 5 or more Throws, 4 to 1. The house's theoretical advantage ranges from+7.41% to+17.12%. In making a Player's claim side bet, a player is wagering on final numerical value for the player's score. All Player's claim side bets lose if the player makes a Player Six Shooter. Winning bets are paid 5 to 1. The house's theoretical expectation for any Player's claim side bet is +4.76%.

The dealer then rolls the final pair of brown dice. Additional D buttons 32 are placed on the appropriate values in the Dealer's Stable 16. At this point the rolling for the game is over. If any values in the Dealer's Stable 16 have more than one D button 32 on them, then the Dealer's claim is established as the value with the most D buttons 32 on it, with the dealer placing a Dealer's claim button 40 on the appropriate die face of the Dealer's Stable 16. That is, the Dealer's claim is the number appearing the most times among the 6 dealer dice. If two or more numbers each are tied in having the most buttons (e.g. 2 buttons each on the numbers 2 and 5 assuming rolls of 2,4,5,5 and 2,6), then the Dealer's claim shall be the highest of these numbers (the number 5 for the example above) and displayed in the same manner with a Dealer's claim button 40. If the six numbers rolled are all different, so that each value in the Dealer's Stable 16 has exactly one D button 32 on it, then this is designated a Dealer Six Shooter.

At this point, all remaining bets are resolved.

The Player Showdown bet is paid 1 to 1 if a Player's claim is greater than a Dealer's claim. If a Player's claim is equal to a Dealer's claim, then the bet is a push or tie. If a Dealer's claim is greater than a Player's claim, the Player Showdown bet is lost. A Player Six Shooter, with any Dealer claim, wins for the Player Showdown bet and is paid 3 to 1. A Dealer Six Shooter loses for the player unless the player also rolled a Player Six Shooter, in which case a Double Six Shooter is said to have occurred. A Double Six Shooter pays 6 to 1 for Player Showdown betters. The house's theoretical expectation, or advantage, for the preferred embodiment of the Player Showdown bet is +2.20%.

The Dealer Win bet pays 1 to 1 if a Dealer's claim is greater than a Player's claim. If a Dealer's claim is less than or equal to a Player's claim, then Dealer Win betters lose. A Dealer Six Shooter, with any Player claim, pays 1 to 1. A Player Six Shooter loses for the Dealer Win bet unless the dealer has also rolled a Dealer Six Shooter. In this case, the Double Six Shooter wins and is paid 6 to 1. The house's theoretical expectation for the preferred embodiment of the Dealer Win bet is +3.16%.

Tie bets pay 5 to 1 if the Player's claim is equal to the Dealer's claim or if there exists a Double Six Shooter. Otherwise the bet is lost. The house's theoretical expectation for the Tie bet is +6.16%.

For wagers on the Jackpot circle area 10 of the layout, a lone Six Shooter (Player or Dealer) pays 6 to 1. A Double Six Shooter pays 600 to 1. The house's theoretical expectation for the Jackpot side bet is +12.73%.

While the invention has been described with reference to a preferred embodiment, other variations or modifications will be apparent to those skilled in the art. Therefore, the invention should not be limited by the foregoing description. Rather, the scope is to be interpreted only in conjunction with the appended claims.

What is claimed:

1. A method of playing a casino game, to be played with money, gaming chips, credits, or their video or mechanical equivalent, comprising the step of:

employing dice or their video or mechanical equivalent to determine a dealer's score DS, which may be a numerical value between 1 and 6 inclusive, or a wildcard value;

employing dice or their video or mechanical equivalent to determine a player's score PS, which may be a numerical value between 1 and 6 inclusive, or a wildcard value;

a) setting a collection of rewards N for different contingencies and establishment of DS and PS;

b) taking bets for a previously selected subset N1 of N;

c) taking bets for a previously selected subset N2 of N;

d) a designated dealer making a number of rolls, where said number between 0 and the number necessary to establish DS, inclusive, while taking bets for N2;

e) a designated player rolling to establish PS;

e1) during a portion of step (e), taking bets for a previously selected subset NN2 of N2;

e2) during a portion of step (e), taking bets for a previously selected subset N3 of N, and rewarding successful bets and collecting unsuccessful bets in accordance with N3;

f) rewarding successful bets and collecting unsuccessful bets in accordance with N2;

g) if DS has not been established, said dealer completing the establishment of DS;

h) rewarding successful bets and collecting unsuccessful bets in accordance with N1; a game layout comprising a substrate, said layout including a plurality of areas for wagering upon N.

2. The method of playing a casino game of claim (1) wherein the method of establishing DS comprising the steps of:

a) splitting a total of 6 dice into a number of smaller groups of die or dice;

b) rolling each said group in succession, until 6 dice have been rolled;

c) establishing DS as the highest number appearing the most times among the 6 dice, unless all dice have different values in which case DS is established as the wildcard value.

3. The method of playing a casino game of claim (1) wherein the method of establishing DS is comprising the steps:

a) splitting a total of 6 dice into a number of smaller groups of die or dice;

b) rolling each said group in succession, until 6 dice have been rolled;

c) establishing DS as the lowest number appearing the most times among the 6 dice, unless all dice have different values in which case DS is established as the wildcard value.

4. The method of playing a casino game of claim (1) wherein the method of establishing DS comprising the steps of:

a) initializing an integer NRD to zero;

b) initializing a set D as empty;

c) rolling a group of two dice, hence:

c1) incrementing NRD by 1;

c2) if said dice have an equal value (i.e. doubles), repeating step (c);

c3) if said dice have different values, both of which are elements of D, repeating step (c);

c4) if said dice have different values, neither of which are elements of D, adding said values as elements of D, hence:

c4a) if D has less than six elements, repeating step (c);

c4b) if D has six elements, corresponding to the values 1 through 6, establishing DS as the wildcard value;

c5) if said dice have different values, one of which is an element of D, the other of which is not an element of D, establishing DS as said value that is an element of D.

5. The method of playing a casino game of claim (1) wherein the method of establishing DS comprising the steps of:

a) initializing an integer NRD to zero;

b) initializing a set D as empty;

c) rolling a group of two dice, hence:

c1) incrementing NRD by 1;

c2) if said dice have an equal value (i.e. doubles), establishing DS as said value;

c3) if said dice have different values, both of which are elements of D, repeating step (c);

c4) if said dice have different values, neither of which are elements of D, adding said values as elements of D, hence:

c4a) if D has less than six elements, repeating step (c);

c4b) if D has six elements, corresponding to the values 1 through 6, establishing DS as the wildcard value;

c5) if said dice have different values, one of which is an element of D, the other of which is not an element of D, establishing DS as said value that is an element of D.

6. The method of playing a casino game of claim (1) wherein the method of establishing DS comprising the steps of:

a) initializing an integer NRD to zero;

b) initializing a set D as empty;

c) rolling a group of one die, hence:

c1) incrementing NRD by 1;

c2) if value of said die is not an element of D, adding said value as an element of D, hence:

c2a) if D has less than six elements, repeating step (c);

c2b) if D has six elements, corresponding to the values 1 through 6, establishing DS as the wildcard value;

c3) if value of said die is an element of D, establishing DS as said value.

7. The method of playing a casino game of claim (1) wherein the method of establishing PS comprising the steps of:

a) splitting a total of 6 dice into a number of smaller groups of die or dice;

b) rolling each said group in succession, until 6 dice have been rolled;

c) establishing PS as the highest number appearing the most times among the 6 dice, unless all dice have different values in which ease PS is established as the wildcard value.

8. The method of playing a casino game of claim (1) wherein the method of establishing PS comprising the steps of:

a) splitting a total of 6 dice into a number of smaller groups of die or dice;

b) rolling each said group in succession, until 6 dice have been rolled;

c) establishing PS as the lowest number appearing the most times among the 6 dice, unless all dice have different values in which case PS is established as the wildcard value.

9. The method of playing a casino game of claim (1) wherein the method of establishing PS comprising the steps of:

a) initializing an integer NR to zero;

b) initializing a set P as empty;

c) rolling a group of two dice, hence:

c1) incrementing NR by 1;

c2) if said dice have an equal value (i.e. doubles), repeating step (c);

c3) if said dice have different values, both of which are elements of P, repeating step (c);

c4) if said dice have different values, neither of which are elements of P, adding said values as elements of P, hence:

c4a) if P has less than six elements, repeating step (c);

c4b) if P has six elements, corresponding to the values 1 through 6, establishing PS as the wildcard value;

c5) if said dice have different values, one of which is an element of P, the other of which is not an element of P, establishing PS as said value that is an element of P.

10. The method of playing a casino game of claim (1) wherein the method of establishing PS comprising the steps of:

a) initializing an integer NR to zero;

b) initializing a set P as empty;

c) rolling a group of two dice, hence:

c1) incrementing NR by 1;

c2) if said dice have an equal value (i.e. doubles), establishing PS as said value;

c3) if said dice have different values, both of which are elements of P, repeating step (c);

c4) if said dice have different values, neither of which are elements of P, adding said values as elements of P, hence:

c4a) if P has less than six elements, repeating step (c);

c4b) if P has six elements, corresponding to the values 1 through 6, establishing PS as the wildcard value;

c5) if said dice have different values, one of which is an element of P, the other of which is not an element of P, establishing PS as said value that is an element of P.

11. The method of playing a casino game of claim (1) wherein the method of establishing PS comprising the steps of:

a) initializing an integer NR to zero;

b) initializing a set P as empty;

c) rolling a group of one die, hence:

c1) incrementing NR by 1;

c2) if value of said die is not an element of P, adding said value as an dement of P, hence:

c2a) if P has less than six elements, repeating step (c);

c2b) if P has six elements, corresponding to the values 1 through 6, establishing PS as the wildcard value;

c3) if value of said die is an element of P, establishing PS as said value.

12. A casino game of claim (1), wherein N comprising the steps of:

a) setting rewards based on a comparison of the values PS and DS;

b) setting rewards on whether the values PS and DS will be wildcard values;

c) setting rewards on a whether a subset of integers I1 will contain the final value of NR;

d) setting rewards on a subset PS1 of numerical values of PS;

e) setting rewards on a single roll, wherein a winning bet requires the establishment of a numerical value of PS on the next roll;

f) setting rewards on a single roll, wherein a winning bet requires the non-establishment of a numerical value of PS on the next roll, barring a subset R of possible rolls.

13. A casino game of claim (1), wherein N1 comprising the steps of:

a) setting rewards based on a comparison of the values PS and DS;

b) setting rewards on whether the values PS and DS will be wildcard values.

14. A casino game of claim (1), wherein N2 is comprised of:

a) setting rewards on a whether a subset of integers I1 will contain the final value of NR;

b) setting rewards on a subset PS1 of numerical values of PS.

15. A casino game of claim (1), wherein NN2 comprising the steps of:

a) setting rewards on a subset PS1 of numerical values of PS.

16. A casino game of claim (1), wherein N3 is comprised of:

a) setting rewards on a single roll, wherein a winning bet requires the establishment of a numerical value of PS on the next roll;

b) setting rewards on a single roll, wherein a winning bet requires the non-establishment of a numerical value of PS on the next roll, barring a subset R of possible rolls.

17. The method of playing a casino game as set forth in claim (1), wherein the method of said dealer in step (d) comprising the steps of rolling and partially completing the establishment of the value DS, during which time taking bets for rewards determined in accordance with N2, said dealer stopping said rolling at a time when the establishment of DS is still at least one roll away.

18. The method of playing a casino game as set forth in claim (1), wherein the method of said dealer is to complete the establishment of DS in step (d), while taking bets for rewards determined in accordance with N2.

19. The method of playing a casino game as set forth in claim (1), wherein the method of said dealer is to roll zero times in step (d), hence to begin rolling only after the player has established PS, completely establishing DS in step (g).

20. A method of using dice or their video or mechanical equivalent to establish scores SA, SB, SC, SD, and SE, each of which may be a numerical value between 1 and 6 inclusive or a wildcard value, comprising the steps of:

for SA and SB:

a) splitting a total of 6 dice into an arbitrary number of smaller groups of die or dice;

b) rolling each said group in succession, until 6 dice have been rolled;

c) establishing SA as the highest number appearing the most times among the 6 dice, unless all dice have different values in which case SA is established as the wildcard value;

d) establishing SB as the lowest number appearing the most times among the 6 dice, unless all dice have different values in which case SB is established as the wildcard value; for SC:

e) initializing an integer NR1 to zero;

f) initializing a set Z as empty;

g) rolling a group of two dice, hence:

g1) incrementing NR1 by 1;

g2) if said dice of (g) have the same value(i.e. doubles), repeating step (g);

g3) if said dice of (g) have different values, both of which are elements of Z, repeating step (g);

g4) if said dice of (g) have different values, neither of which are elements of Z, adding said values as elements of Z, hence:

g4a) if Z has less than six elements, repeating step (g);

g4b) if Z has six elements, corresponding to the values 1 through 6, establishing SC as the wildcard value;

g5) if said dice of (g) have different values, one of which is an element of Z, the other of which is not an element of Z, establishing SC as said value that is an element of Z for SD:

h) initializing an integer NR1 to zero;

i) initializing a set Z as empty;

j) rolling a group of two dice, hence:

j1) incrementing NR1 by 1;

j2) if said dice of (j) have the same value (i.e. doubles), establishing SD as said value;

j3) if said dice of (j) have different values, both of which am elements of Z, repeating step (j);

j4) if said dice of (j) have different values, neither of which are elements of Z, adding said values as elements of Z, hence:

j4a) if Z has less than six elements, repeating step (j);

j4b) if Z has six elements, corresponding to the values 1 through 6, establishing SD as the wildcard value;

j5) if said dice of (j) have different values, one of which is an element of Z, the other of which is not an element of Z, establishing SD as said value that is an element of Z, for SE:

k) initializing an integer NR1 to zero;

l) initializing a set z as empty;

m) rolling a group of one die, hence:

m1) incrementing NR1 by 1;

m2) if value of said die of (m) is not an element of Z, adding said value as an element of Z, hence:

m2a) if Z has less than six elements, repeating step (m);

m2b) if Z has six elements, corresponding to the values 1 through 6, establishing SE as the wildcard value;

m3) if value of said die of (m) is an element of Z, establishing SE as said value.

21. A method of establishing scores as set forth in claim (20), wherein the scores are used in a casino game comprising the steps of:

assigning one of S1, S2, S3, S4, or S5 to be a dealer's score, denoted by DS; assigning one of S1, S2, S3, S4, or S5 to be a player's score, denoted by PS;

a) setting rewards based on a comparison of the values PS and DS;

b) setting rewards on whether the values PS and DS will be wildcard values;

c) setting rewards on a subset I1, representing the number of rolls required to establish PS, of integers;

d) setting rewards on a subset of numerical values of PS;

e) setting rewards on a single roll of the dice, wherein a winning bet requires the establishment of a numerical value of PS on the next roll;

f) setting rewards on a single roll of the dice, wherein a winning bet requires the non-establishment of a numerical value of PS on the next roll, barring a subset R of possible rolls;

g) taking bets for rewards determined in accordance with steps (a) through (d);

h) a designated dealer rolling a number of said groups of dice, said number being between 0 and the number necessary to establish the value DS, inclusive, during which time taking bets for rewards determined in accordance with steps (c) and (d);

i) a designated player establishing the value PS, during which time:

i1) if PS is one of SC, SD, or SE, taking bets for rewards determined in accordance with step (d) if Z is empty, and taking bets for steps (e) and (f) if Z is not empty, and after each single roll subsequently rewarding successful bets and collecting unsuccessful bets in accordance with steps (e) and (f);

j) rewarding successful bets and collecting unsuccessful bets in accordance with steps (c) and (d);

k) if DS has not been established, said dealer completing the establishment of DS;

l) rewarding successful bets and collecting unsuccessful bets in accordance with steps (a) and (b), a game layout comprising a substrate, said layout including a plurality of areas for wagering upon different contingencies for the scores and establishment of PS and DS.

22. A method of playing a casino game, to be played with conventional six-sided dice or their video or mechanical equivalent and to be wagered upon with money, gaming chips, credits, or their video or mechanical equivalent, comprising the steps of:

a) setting rewards based on a comparison of a player's score PS and a dealer's score DS;

b) setting rewards on whether the values PS and DS will be wildcard values;

c) setting rewards on a subset I1, representing the number of rolls required to establish PS, of integers;

d) setting rewards on a subset of numerical values of PS;

e) setting rewards on a single roll of the dice, wherein a winning bet requires the establishment of a numerical value of PS on the next roll;

f) setting rewards on a single roll of the dice, wherein a winning bet requires the non-establishment of a numerical value of PS on the next roll, barring a subset R of possible rolls;

g) taking bets for rewards determined in accordance with steps (a) through (d);

h) a designated dealer rolling a group of four dice;

i) taking bets for rewards determined in accordance with steps (c) and (d);

j) initializing an integer NR1 to zero;

k) initializing a set Z as empty;

l) a designated player rolling a group of two dice, hence:

l1) incrementing NR1 by 1;

l2) if said dice of (1) have the same value (i.e. doubles), repeating step (1);

l3) if said dice of (1) have different values, both of which are elements of Z, repeating step (1);

l4) if said dice of (1) have different values, neither of which are elements of Z, adding said values as elements of Z, hence:

l4a) if Z has less than six elements, repeating step (1);

l4b) if Z has six elements, corresponding to the values 1 through 6, establishing PS as a wildcard value;

l5) if said dice of (1) have different values, one of which is an element of Z, the other of which is not an element of Z, establishing PS as said value that is an element of Z.

m) during step (1), taking bets for step (d) if Z is empty, and taking bets for steps (e) and (f) if Z is not empty, and after each single roll subsequently rewarding successful bets and collecting unsuccessful bets in accordance with steps (e) and (f);

n) rewarding successful bets and collecting unsuccessful bets in accordance with steps (c) and (d);

o) said dealer rolling two dice;

p) establishing DS as the highest number appearing the most times among the six dealer dice, unless all dice have different values in which case DS is established as a wildcard value;

q) rewarding sucessful bets and collecting unsuccessful bets in accordance with steps (a) and (b);

a game layout comprising a substrate, said layout including a plurality of areas for wagering upon different contingences for the scores and establishment of PS and DS.

* * * * *